US006142530A

United States Patent [19]

Emmerich

[11] Patent Number: 6,142,530

[45] Date of Patent: Nov. 7, 2000

[54] CHILDREN'S BOOK HAVING PICTURES WITH INTEGRATED PHOTOGRAPHS

[76] Inventor: Karin Emmerich, Westl. Hauptstrasse 19, D-76684 Östringen, Germany

[21] Appl. No.: 09/275,146

[22] Filed: Mar. 24, 1999

[30] Foreign Application Priority Data

| | | | |
|---|---|---|---|
| Mar. 24, 1998 | [DE] | Germany | 198 13 968 |
| Mar. 25, 1998 | [DE] | Germany | 298 05 411 U |
| Dec. 17, 1998 | [DE] | Germany | 298 22 474 U |

[51] Int. Cl.[7] ..... B65D 33/16

[52] U.S. Cl. ..... 283/63.1; 281/15.1; 281/38; 281/51; 283/67; 283/70; 412/2; 412/4

[58] Field of Search ..... 281/3.1, 15.1, 281/38, 51; 283/63.1, 67, 70, 117, 101; 412/2, 4

[56] References Cited

U.S. PATENT DOCUMENTS

| | | | |
|---|---|---|---|
| 2,489,240 | 11/1949 | Meyer | 46/34 |
| 5,031,935 | 7/1991 | D Andrea | 281/15.1 |
| 5,238,345 | 8/1993 | D Andrea | 412/4 |
| 5,240,287 | 8/1993 | Nirmel | 283/101 |
| 5,397,156 | 3/1995 | Schach et al. | 283/67 |
| 5,478,120 | 12/1995 | D Andrea | 283/117 |
| 5,597,183 | 1/1997 | Johnson | 283/83 |
| 5,772,247 | 7/1998 | Legrand | 281/31 |
| 5,787,617 | 8/1998 | Testa | 40/124.06 |
| 5,816,730 | 10/1998 | Alspaw et al. | 281/22 |
| 5,829,790 | 11/1998 | Philips | 283/117 |
| 5,871,237 | 2/1999 | Hunt | 281/21.1 |

*Primary Examiner*—Willmon Fridie, Jr.
*Assistant Examiner*—Daniel Phan
*Attorney, Agent, or Firm*—Akin, Gump, Strauss, Hauer & Feld, L.L.P.

[57] ABSTRACT

A book is provided, especially for children, having a cover and a content including several pages, on which pictures and/or text are found. In order to ensure that children approach a book of this type with great enthusiasm, this book is individualized, in that the owner of the book appears in the book him-/herself. Since mentioning by name in the continuous text would lead to undesirable empty spaces, or even to unwanted line, paragraph and page breaks, however, areas are provided in the pictures, which are already present in the book, for applying a photographic representation of the owner of the book.

2 Claims, 1 Drawing Sheet

CHILDREN'S BOOK HAVING PICTURES WITH INTEGRATED PHOTOGRAPHS

BACKGROUND OF THE INVENTION

The invention concerns a book, especially for children, having a cover and a contents consisting of several pages on which pictures (images) or a text and pictures are found.

Books of this type are especially used by children. In this regard, pure picture books are especially selected by small and preschool children, while books with text and a large image component are in particular "read" by primary school children.

In this connection, it can for example also be increasingly established, due to the heavy television consumption by children, that the latter build up a less close relationship to books than was previously more typical.

In order to break down children's fear of contact with books, it is already known to insert individualized names in book texts. However, this can be addressed only with children already capable of reading.

Moreover, this has the considerable disadvantage that the text of the book must be separately printed each time, since the individualized names are of different length, and otherwise undesirable empty spaces would thus result in the areas of the names. Since at the same time, line, paragraph and page breaks are also altered, this separate printing is very expensive.

SUMMARY OF THE INVENTION

An object of the present invention is therefore to create an appropriately individualized book in which such problems do not arise.

This objective is accomplished in accordance with the invention in that areas are provided in the pictures in the book for applying photographic representations.

The invention has the advantage that, in connection with the production of the book, the layout no longer needs to be changed, and the individualization can consequently be carried out considerably more economically. Here, it is especially intended to use pictures of the child for whom the book is to be individualized for the photographic representations. Consequently, it is thus ensured that the child sees himself or herself in the story, and therefore identifies more strongly with the events described in the book, and has a greater affinity both to this story, as well as to the book itself.

Advantageously, the areas on which the photographic representations are to be applied are surrounded by a marking, which essentially establishes the corner points, so that it is simple to position a photograph or a suitable photographic segment exactly on a picture, so that the overall optimal image effect occurs.

Moreover, in order for the photographic representation to be attached securely in this area, the area can be provided with an adhesive layer.

Especially with picture books in which the page surfaces have a dirt-repellant covering, it has proven beneficial to provide the area for the photographic representation with a rough surface, to which an adhesive can attach itself for fastening the photo.

For this purpose, it is especially recommended that the photo be transferred to a sheet which is coated with adhesive on one side and which can then be adhered to the desired area.

In an alternative embodiment of the invention, it is recommended to use pictures which are storable in a computer, so that they are also processable there by supplementing a photographic representation, and can then be printed out in this form.

For the photographic representations to be used, it is especially recommended that they be recorded by a digital camera, whereby they can be especially well processed in a computer.

In this connection, it has proven especially advantageous for the image to be executed as a drawing, whereby little gray tone must be stored in the computer. Moreover, a special accentuation of the photographic object is thereby attainable.

In addition, it is also possible to manufacture a coloring book in this manner, which appropriately encourages the readiness of a child to color, due to its basically black and white execution.

BRIEF DESCRIPTION OF THE DRAWING

The foregoing summary, as well as the following detailed description of the invention, will be better understood when read in conjunction with the appended drawing. For the purpose of illustrating the invention, there are shown in the drawing embodiment(s) which are presently preferred. It should be understood, however, that the invention is not limited to the precise arrangements and instrumentalities shown. In the drawing:

The sole FIGURE shows a diagrammatic sketch of a book according to the invention.

DETAILED DESCRIPTION OF THE INVENTION

Figure 1:
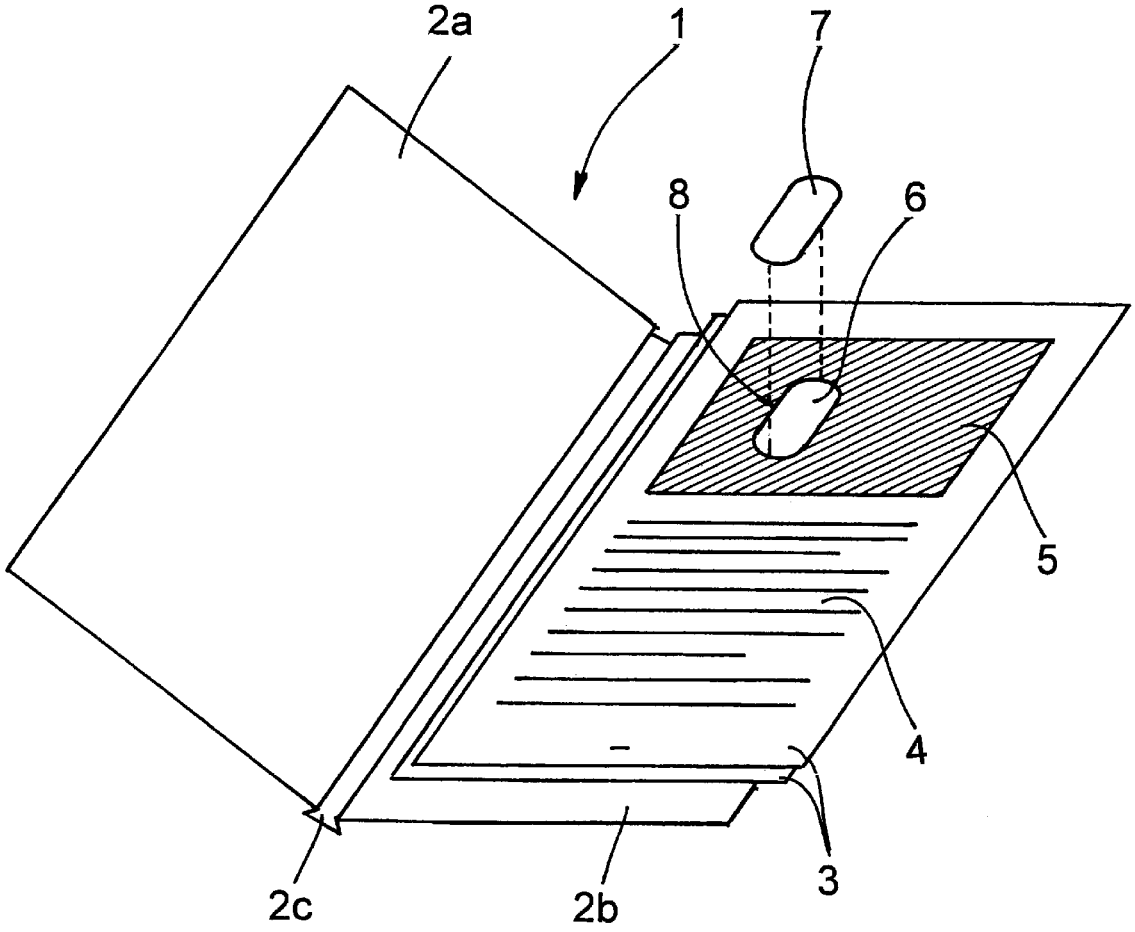

In the drawing one recognizes a book which is designated overall with 1. This has a cover 2 which has a book back (binding) 2*c* in addition to a front book cover 2*a* and a rear book cover 2*b*. A plurality of pages 3 can be fastened in this cover in a known manner, the content of which consists of text 4 and/or pictures 5.

In addition to pages which, as shown, contain text 4 as well as a picture 5, there may also be pages which contain only text or only pictures.

In picture 5, there is located an area 6 in which a photographic representation 7 can be applied.

The content of the photographic representation is consequently integrated into picture 5. A child represented in this photographic representation consequently finds him-/herself again in the situation represented on picture 5. He/she can consequently identify with the situation represented in the picture and described in the text, which brings about a particularly intense experience of the story printed in the book, so that he/she will therefore have an especially close relationship to the book. A basically positive underlying attitude toward books in general can thereby be created. Moreover, this effect even occurs with small children, who indeed cannot yet read, but who can already recognize pictures.

So that the photographic representation 7 can be exactly fitted into the picture 5, the appropriate area 6 is surrounded by a marking 8. Within this marking 8 an adhesive layer can also be located, which is not represented in greater detail here.

It is also not shown that, optionally, the photographic representation 7 can be separately read into a computer, for example also directly from a digital camera, and is worked into the area 6 of the picture 5, which is already present in the computer, after which page 3 is then printed out as a whole.

Since here only the picture area 5 is altered by adding the photographic representation in the area 6, it is not to be feared that the text 4 will therefore be shifted to another page.

Also, for a computer processing it is especially beneficial for the picture 5 to be a drawing. Such a drawing, however, also forms a good basis for a coloring book, which promotes in a child the readiness for coloring.

Besides such a processing through a computer, however, drawings can also especially easily be copied together with the applied picture of a child in a conventional manner ,which facilitates the producibility of the book, and whereby the original picture and the original photograph remain equally preserved.

Overall, the invention consequently represents a possibility for manufacturing individualized books, without at the same time having to fear that each page will always require a new layout.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

What is claimed is:

1. A book (1), especially for children, comprising:

a cover (2); and a contents comprising:

a plurality of pages (3);

at least one computer generated picture (5) and text positioned on the pages, wherein the at least one computer generated picture comprises:

a pre-set picture portion representing picture data stored in the computer;

an individual portion which contains a photographic representation (7) of an individual, wherein the computer generated picture effectively combines the photographic representation (7) with the pre-set picture portion so that the individual portion and the pre-set picture portion form an integral picture.

2. A book (1), especially for children, comprising:

a cover (2); and a contents comprising:

a plurality of pages (3);

at least one computer generated picture (5) and text positioned on the pages, wherein the at least one computer generated picture comprises:

a pre-set drawing portion representing drawing data stored in the computer;

an individual portion which contains a photographic representation of an individual, wherein the computer generated picture effectively combines the photographic representation (7) with the pre-set picture portion so that the individual portion and the pre-set drawing portion form a combination of the photographic representation of the individual and the pre-set drawing portion which is suitable for coloring by a child.

* * * * *